United States Patent [19]

Kitagawa

[11] 3,985,285

[45] Oct. 12, 1976

[54] COLLAPSIBLE BOX

[76] Inventor: Yoshiko Kitagawa, 17-25, Wakabayashi 2-chome, Setagaya, Tokyo, Japan

[22] Filed: Sept. 8, 1975

[21] Appl. No.: 611,411

[30] Foreign Application Priority Data

Sept. 9, 1974 Japan ..... 49-108365

[52] U.S. Cl. ..... 229/8; 229/41 C; 40/126 A

[51] Int. Cl.[2] ..... B65D 5/32

[58] Field of Search ..... 229/8, 22; 40/120 A

[56] References Cited

UNITED STATES PATENTS

| | | | |
|---|---|---|---|
| 618,275 | 1/1899 | Kerr | 229/8 |
| 1,292,188 | 1/1919 | Wheeler | 229/8 UX |
| 1,649,088 | 11/1927 | Tinsley | 229/8 |
| 2,682,987 | 7/1954 | Spiess, Jr. | 229/3.5 MF UX |
| 2,936,939 | 5/1960 | Lundquist | 229/8 |
| 3,571,958 | 3/1971 | Stevens | 40/126 A |
| 3,664,571 | 5/1972 | Lesar | 229/8 |
| 3,668,796 | 6/1972 | Patterson | 48/126 A |
| 3,768,720 | 10/1973 | Bundy | 229/41 C X |

*Primary Examiner*—Davis T. Moorhead
*Attorney, Agent, or Firm*—Flynn & Frishauf

[57] ABSTRACT

This invention relates to a collapsible polygonal box made of paperboard or foil-laminated paperboard, or the like which takes little space when collapsed and stored, and which can be easily restored to an upright position by folding. The collapsible box comprises a plurality of unit members each divided into a generally triangular base portion, one or more side wall portions, and a lid portion.

15 Claims, 17 Drawing Figures

COLLAPSIBLE BOX

BACKGROUND OF THE INVENTION

This invention relates to a collapsible polygonal box made of paperboard or foil-laminated paperboard which takes little space when collapsed and stored, and which can be easily restored to an upright position by folding.

Conventionally, collapsible polygonal boxes for containing complimentary gifts or precious objects, especially collapsible boxes ranging from square box to octagonal box have been made by folding a single side wall unit to form a desired polygonal shape and by pasting one of its end to the other. However, such collapsible polygonal boxes had some defects to be solved. For one thing, an outer side wall thereof could not be easily pasted to the other outer side wall, and in case of pentagonal or heptagonal box, once pasted, it was practically impossible to collapse and flatten the finished box. So it required a huge space to store a number of empty boxes of this type, which was not desirable from an economical point of view. In addition to this, the shape of a material cut from paperboard or foil-laminated paperboard was so irregular having many different portions that a lot of waste was inevitable in the use of the paperboard.

SUMMARY OF THE INVENTION

As an improvement on the conventional collapsible polygonal boxes that have the defects mentioned above, the present invention permits the making of polygonal boxes, such as square box, pentagonal box, hexagonal box, heptagonal box or octagonal box of collapsible type. The box of the present invention occupies little space when stored and enables an economical use of paperboard or foil-laminated paperboard of a specified size without waste.

BRIEF DESCRIPTION OF THE DRAWINGS

FIG. 1 is perspective view of the box while it is collapsed and stored; FIG. 2 is a plan view of the box in an opened state; FIG. 3 is a perspective view of the box while being folded in; and FIG. 4 is a perspective view of the finished box.

FIG. 5 is perspctive view of the box while it is collapsed and stored; FIG. 6 is a plan view of the box in an opened state; FIG. 7 is a perspective view of the box while being folded in; and FIG. 8 is a perspective view of the finished box.

FIG. 9 is perspective view of the box while it is collapsed and stored; FIG. 10 is a plan view of the box in an opened state; FIG. 11 is a perspective view of the box while being folded in; and FIG. 12 is a perspective view of the finished box.

FIG. 13 is perspective view of the box while it is collapsed and stored; FIG. 14 is a plan view of the box in an opened state; FIG. 15 is a perspective view of the box while being folded in; and FIG. 16 is a perspective view of the finished box.

DESCRIPTION OF THE PREFERRED EMBODIMENTS

This invention relates to a collapsible box comprising a plurality of unit members each divided, in sequence, into a generally triangular base portion, one or more side wall portions and a lid portion provided at the end thereof with two semicircular inter-engaging portions, the fold line between said base portion and said side wall portion contacting therewith being always parallel to the fold line between said lid portion and said side wall portion contacting therewith, and said unit members being pivotally connected at a point close to the apex of each base portion.

The present invention is now explained more specifically in accordance with the attached drawings.

Figure 1:
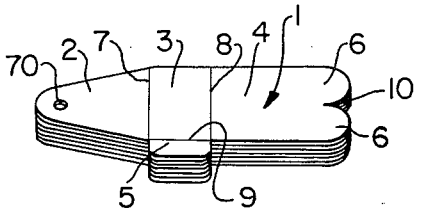
FIGS. 1 to 4 show a collapsible box according to the first embodiment of the present invention.
Figure 2:
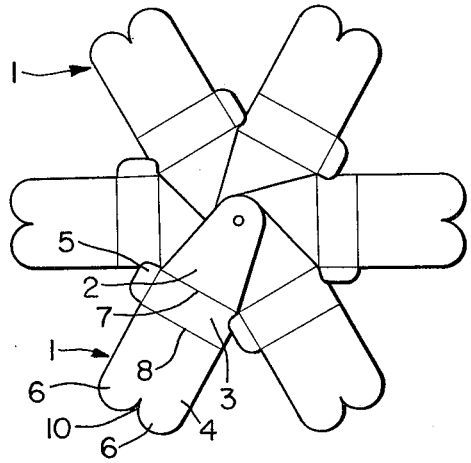

FIGS. 1 to 4 show a collapsible box according to the first embodiment of the present invention. As shown in FIG. 1 a unit member 1 a plurality of which forms the collapsible box of the first embodiment of the present invention is divided into the three portions: a generally triangular base portion 2, a side wall portion 3 and a lid portion 4, and the unit is to be folded on the lines 7 and 8. The side wall 3 is formed with a tab 5 via a fold line 9. The end of the lid portion 4 is provided with two semicircular inter-engaging portions 6 with a cut or notch 10 between the semicircular portions 6. When a collapsible polygonal box is to be made, a plurality of the units 1 (corresponding to the number of the angles of the box lid or base) are pivotally connected at a point close to the apex of each base member 2 by a fixing means made of a metal, a synthetic resin or the like, in apertures 70. FIG. 2 is a plan view showing how the collapsible box of this invention looks when opened. A hexagonal box is shown in the figure but other polygonal boxes ranging from square box to octagonal box can be made.

Figure 3:
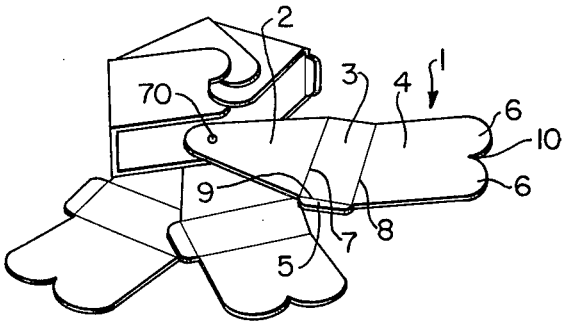
Figure 4:
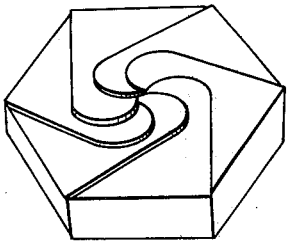

We now describe how to bring the collapsible box of this invention to an upright position. Starting with the opened position shown in FIG. 2, each side wall 3 is bent upright on the line 7, the tab 5 is tucked inwardly of an adjacent unit member 1, and then as shown in FIG. 3, the lid portion 4 is consecutively bent downwardly to come under an adjacent lid portion with the cut or notch 10 of the inter-engaging portion 6 being fixedly engaged with the next cut. This leads to a final upright position shown in FIG. 4.

Figure 5:
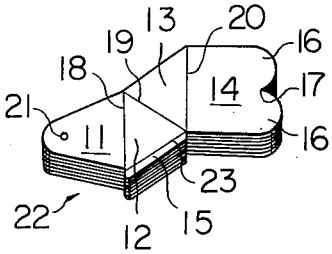
FIGS. 5 to 8 show a collapsible box according the second embodiment of the present invention.
Figure 6:
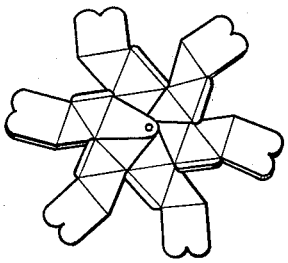
Figure 7:
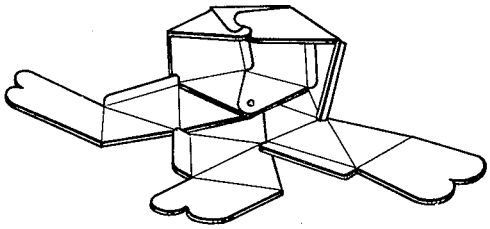
Figure 8:
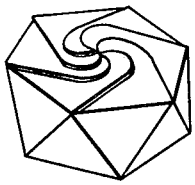

The collapsible box according to the second embodiment of the present invention is explained referring to FIGS. 5 to 8. As shown in FIG. 5, a unit member 22 a plurality of which forms the collapsible box of the second embodiment of the present invention is divided into the four portions: a generally triangular base portion 11, triangular side wall portions 12 and 13 and a lid portion 14, and the unit is to be folded on the lines 18, 19 and 20. The side wall 12 is formed wih a tab 15 via a fold line 23. The end of the lid portion 14 is provided with two semicircular inter-engaging portions 16. When a collapsible polygonal box is to be made, a plurality of the units 22 (corresponding to the number of the angles of the box lid or base) are pivotally connected at a point close to the apex of each base member 21 by a fixing means made of a metal, a synthetic resin or the like. The fold line between said base portion and said side wall portion is always parallel to the fold line between said side wall portion and said lid portion. FIG. 6 is a plan view showing how the collapsible box of this embodiment looks opened. A hexagonal box is shown in the figure but other polygonal boxes ranging from square box to octagonal box can be made. How to bring the collapsible box of the second embodiment to an upright position is similar to that of the box of the first embodiment.

Figure 9:
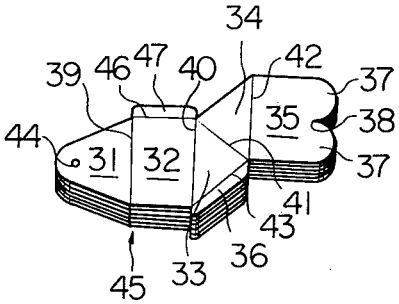
FIGS. 9 to 12 show a collapsible box according the third embodiment of the present invention.
Figure 10:
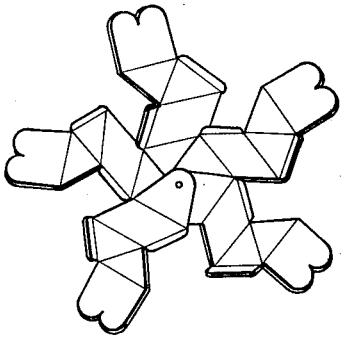
Figure 11:
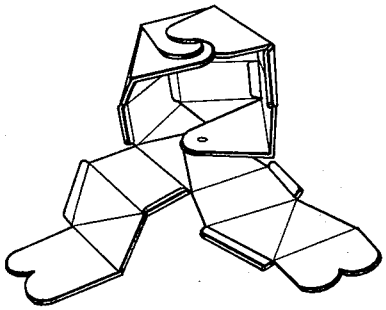
Figure 12:
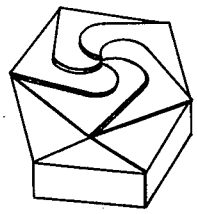

The collapsible box according to the third embodiment of the present invention is explained referring to FIGS. 9 to 12. As shown in FIG. 9, a unit member 45 a plurality of which forms the collapsible box of the third embodiment of the present invention is divided into the five portions: a generally triangular base portion 31, square side wall portion 32, triangular side wall portions 33 and 34 and a lid portion 35, and the unit is to be folded on the lines 39, 40, 41 and 42. The side walls 32 and 33 are formed with tabs 47 and 36 via fold lines 46 and 43, respectively. The end of the lid portion 35 is provided with two semicircular inter-engaging portions 37. When a collapsible polygonal box is to be made, a plurality of the units 45 (corresponding to the number of the angles of the box lid or base) are pivotally connected at a point close to the apex of each base member 44 by a fixing means made of a metal, a synthetic resin or the like. The fold line between said base portion and said side wall portion contacting therewith is always parallel to the fold line between said lid portion and said side wall portion contacting therewith. FIG. 10 is a plan view showing how the collapsible box of this embodiment looks open. A pentagonal box is shown in the figure but other polygonal boxes ranging from square box to octagonal box can be made. How to bring the collapsible box of the third embodiment to an upright position is similar to that of the box of the first embodiment.

Figure 13:
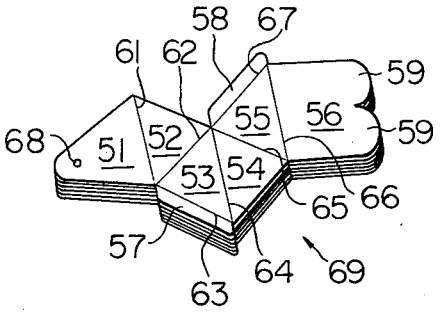
FIGS. 13 to 16 show a collapsible box according the fourth embodiment of the present invention.
Figure 14:
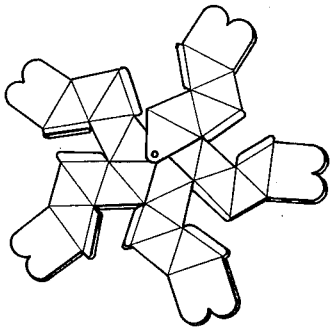
Figure 15:
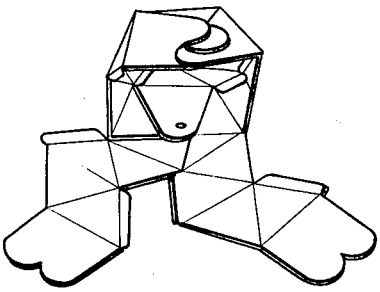
Figure 16:
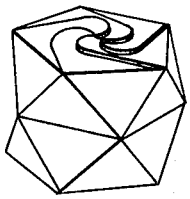

The collapsible box according to the fourth embodiment of the present invention is explained referring to FIGS. 13 to 16. As shown in FIG. 13, a unit member 69 a plurality of which forms the collapsible box of the fourth embodiment of the present invention is divided into the six portions: a generally triangular base portion 51, triangular side wall portions 52, 53, 54 and 55 and a lid portion 56, and the unit is to be folded on the lines 61, 62, 64, 65 and 66. The side walls 53 and 55 are formed with tabs 57 and 58 via fold lines 63 and 67, respectively. The end of the lid portion 56 is provided with two semicircular inter-engaging portions 59. When a collapsible polygonal box is to be made, a plurality of the units 69 (corresponding to the number of the angles of the box lid or base) are pivotally connected at a point close to the apex of each base member 68 by a fixing means made of a metal, a synthetic resin or the like. The fold line between said base portion and said side wall portion contacting therewith is always parallel to the fold line between said lid portion and said side wall portion contacting therewith. FIG. 14 is a plan view showing how the collapsible box of this embodiment looks open. A pentagonal box is shown in the figure but other polygonal boxes ranging from square box to octagonal box can be made. How to bring the collapsible box of the third embodiment to an upright position is similar to that of the box of the first embodiment.

The collapsible box is made of paperboard, foil-laminated paperboard or plastic sheet. Paperboard or foil-laminated paperboard is preferred. The polygonal boxes prepared according to the present invention range from square box to octagonal box. Penta- and hexagonal box are preferred. The present invention discloses four boxes. The collapsible box of the first embodiment is preferred, since a process for making the finished box therefrom is simple.

It is preferred that the unit members be pivotally connected at a point close to the apex of each base portion in such a manner that when they are opened the left end of the fold line contacting base portion or lid portion of every unit member is in contact with the right end of the fold line contacting base portion or lid portion of an adjacent unit on the left. By taking this arrangement, no gap is made between side walls when the box is in an upright position.

In each embodiment, the units may be of different shapes but they are preferably of the same shape.

Figure 17:
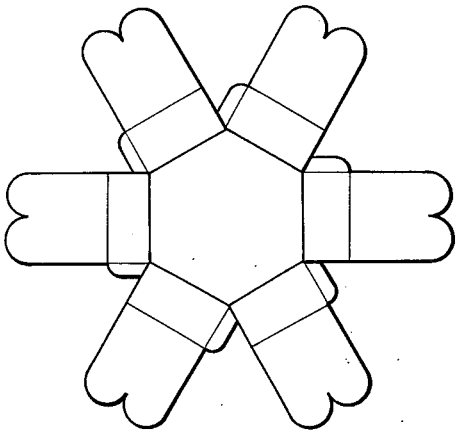
FIG. 17 a plan view of a collapsible box (reference) in its opened state.

In view of the technical concept incorporated in this invention, a collapsible box of another type may be made from the unit pattern illustrated in FIG. 17. However, a unit of such a shape does not allow an economical use of paperboard from which it is cut out. What is more, if the paperboard is of an ordinary size, that is, a square with a side 80 to 110 cm long, and if the length between the farthest ends of the unit described in FIG. 17 is more than 40 cm, only one or two such units are obtained from the paperboard, leaving a considerable portion of the paperboard as waste. But such defects are avoided when the unit member is cut out in the manner according to the present invention. In addition, since side walls need not be pasted together, boxes with an odd number of angles, such as pentagonal or heptagonal boxes, can be made. One final and great advantage resulting from this invention is illustrated in FIGS. 1, 5, 9 and 13; that is, when the box is not used, its unit members can be stacked on top of one another, and therefore only a very small space is necessary for storing them.

What I claim is:

1. A collapsible box comprising:

a plurality of unit members each divided, in sequence, into a generally triangular base portion, at least one side wall portion extending from the base portion with a fold line therebetween, and a lid portion provided at the end thereof with a fold line between the lid portion and a side portion, said lid portion having two adjacent generally semicircular inter-engaging portions forming a notch therebetween at the end thereof, said fold line between said base portion and said side wall portion immediately adjacent thereto being always parallel to said fold line between said lid portion and said side wall portion immediately adjacent to said lid portion; and means for pivotally connecting said unit members together at a point close to the apex of each base portion.

2. A collapsible box comprising:

a plurality of unit members each divided into a generally triangular base portion, a side wall portion connected to said base portion, and a lid portion provided at the end thereof, said lid portion having two adjacent generally semicircular interengaging portions forming a notch therebetween at the end thereof; and means for pivotally connecting said base portions together at a point close to the apex of each base portion.

3. The box defined in claim 1 wherein the box is pentagonal.

4. The box defined in claim 1 wherein the material thereof is paperboard.

5. The box defined in claim 1 wherein the material thereof is foil-laminated paperboard.

6. The box defined in claim 1 wherein the box is hexagonal.

7. The box defined in claim 1 wherein said at least one side wall portion has a tab extending from an edge thereof with a fold line therebetween.

8. The box defined in claim 1 wherein said at least one side wall portion is generally rectangular.

9. The box defined in claim 1 comprising a plurality of adjacent side wall portions interposed between said base portion and lid portion, a fold line being formed between each pair of adjacent side wall portions.

10. The box defined in claim 9 wherein at least one of said side wall portions has a tab extending from an edge thereof with a fold line therebetween.

11. The box defined in claim 9 wherein said side wall portions are generally triangular.

12. The box defined in claim 9 wherein at least one of said side wall portions is generally rectangular.

13. The box defined in claim 12 wherein at least one of said side wall portions is generally triangular.

14. The box defined in claim 9 wherein at least one of said side wall portions is a quadrilateral.

15. The box defined in claim 14 wherein at least one of said side wall portions is generally triangular.

* * * * *